US009281628B2

(12) United States Patent
Wu et al.

(10) Patent No.: US 9,281,628 B2
(45) Date of Patent: Mar. 8, 2016

(54) ELECTRICAL CONNECTOR ASSEMBLY WITH IMPROVED CONTACT

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/583,747

(22) Filed: Dec. 28, 2014

(65) Prior Publication Data

US 2015/0188268 A1 Jul. 2, 2015

(30) Foreign Application Priority Data

Dec. 30, 2013 (CN) ..... 2013 1 0741142

(51) Int. Cl.

| | |
|---|---|
| ***H01R 9/03*** | (2006.01) |
| ***H01R 13/6582*** | (2011.01) |
| ***H01R 13/6593*** | (2011.01) |
| ***H01R 27/02*** | (2006.01) |
| *H01R 107/00* | (2006.01) |
| *H01R 24/62* | (2011.01) |

(52) U.S. Cl.
CPC ..... *H01R 13/6582* (2013.01); *H01R 13/6593* (2013.01); *H01R 27/02* (2013.01); *H01R 24/62* (2013.01); *H01R 2107/00* (2013.01)

(58) Field of Classification Search
CPC ..... H01R 13/6582; H01R 13/6593; H01R 24/62; H01R 27/02; H01R 9/038; H01R 13/6485; H01R 13/6467
USPC ..... 439/607.55
See application file for complete search history.

(56) References Cited

U.S. PATENT DOCUMENTS

| | | | | |
|---|---|---|---|---|
| 6,257,927 | B1 * | 7/2001 | Suzuki | H01R 23/688 439/579 |
| 8,002,589 | B1 * | 8/2011 | Yu | H01R 13/6485 439/660 |
| 8,011,968 | B2 | 9/2011 | Lai et al. | |
| 8,764,486 | B2 * | 7/2014 | Ii | H01R 9/038 439/607.46 |
| 2010/0248552 | A1 * | 9/2010 | He | H01R 27/02 439/638 |
| 2014/0335732 | A1 * | 11/2014 | Oberski | H01R 13/6467 439/626 |

* cited by examiner

*Primary Examiner* — Jean F Duverne
(74) *Attorney, Agent, or Firm* — Wei Te Chung; Ming Chieh Chang

(57) ABSTRACT

A plug connector includes a plug housing (11) defining a receiving space (1110), a plurality of contacts retained in the plug housing, a cable (16) electrically connected with the contacts and a shielding member (15) enclosing on the plug housing to form a cavity. The contacts comprises a plurality of first contacts (12) and a plurality of second contacts (13), stiff contacting portions of the first contacts are exposed in the receiving space, and elastic contacting portions of the second contacts are exposed in the cavity for transmitting high speed signal. The shielding member is enclosing on the plug housing to form a cavity, the cavity is stacked on the receiving space. The slit is communicated with an exterior in the up-to-down direction, the plug connector further comprises an additional contact (18) received in the slit and extending beyond the bottom surface of the plug housing.

13 Claims, 10 Drawing Sheets

ELECTRICAL CONNECTOR ASSEMBLY WITH IMPROVED CONTACT

BACKGROUND OF THE INVENTION

1. Field of the Invention

The present invention relates to an electrical connector assembly, and more particularly to an electrical connector assembly including a receptacle connector and a plug connector transmitting high-speed signal.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals, such as mouse devices, keyboards, PDAs, gamepads and joysticks, scanners, digital cameras, printers, external storage, networking components, etc. For many devices such as scanners and digital cameras, USB has become the standard connection method. As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s).

U.S. Pat. No. 8,011,968 discloses a cable connector assembly in accordance with USB 3.0 Powered-B standard. The cable connector assembly has a power contact and a grounding contact on two opposite side walls thereof, the power contact can directly provide power for peripheral device which connected with the cable connector assembly, without an additional power. However, extra terminals are needed in some electronic equipment to achieve detection and control of client signals, and when extra terminals added, a sub-connector and other components of the cable connector assembly are usually necessary by re-moulded.

An electrical connector assembly with an improved contact is desired.

BRIEF SUMMARY OF THE INVENTION

Accordingly, an object of the present invention is to provide an electrical connector assembly having an improved plug connector and a receptacle connector.

In order to achieve the above-mentioned object, a plug connector of an electrical connector assembly in accordance with the present invention comprises: a plug housing defining a receiving space, a plurality of contacts retained in the plug housing, a cable electrically connected with the contacts and a shielding member enclosing on the plug housing to form a cavity. The contacts comprises a plurality of first contacts and a plurality of second contacts, each first contact has a stiff contacting portion with each second contact having an elastic contacting portion, the stiff contacting portions of the first contacts are exposed in the receiving space, and the elastic contacting portions of the second contacts are exposed in the cavity for transmitting high speed signal. The shielding member is enclosing on the plug housing to form a cavity, the cavity is stacked on the receiving space along an up-to-down direction. The plug housing has a slit on a bottom surface thereof, and the slit is communicated with an exterior in the up-to-down direction, the plug connector further comprises an additional contact received in the slit and extending beyond the bottom surface of the plug housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
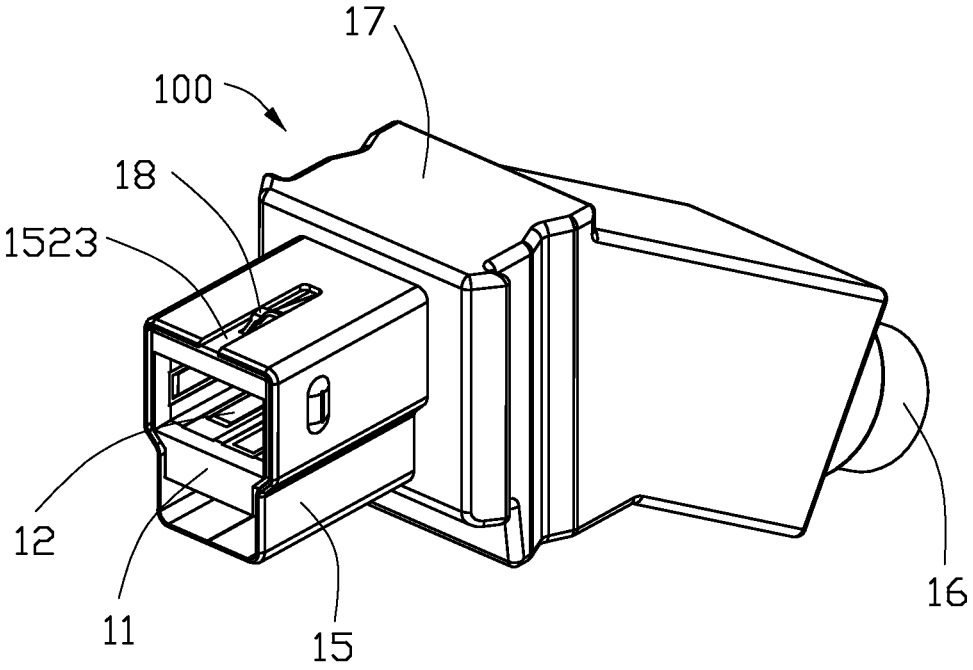
FIG. 1 is a perspective view of a plug connector of an electrical connector assembly according to the present invention.
Figure 2:
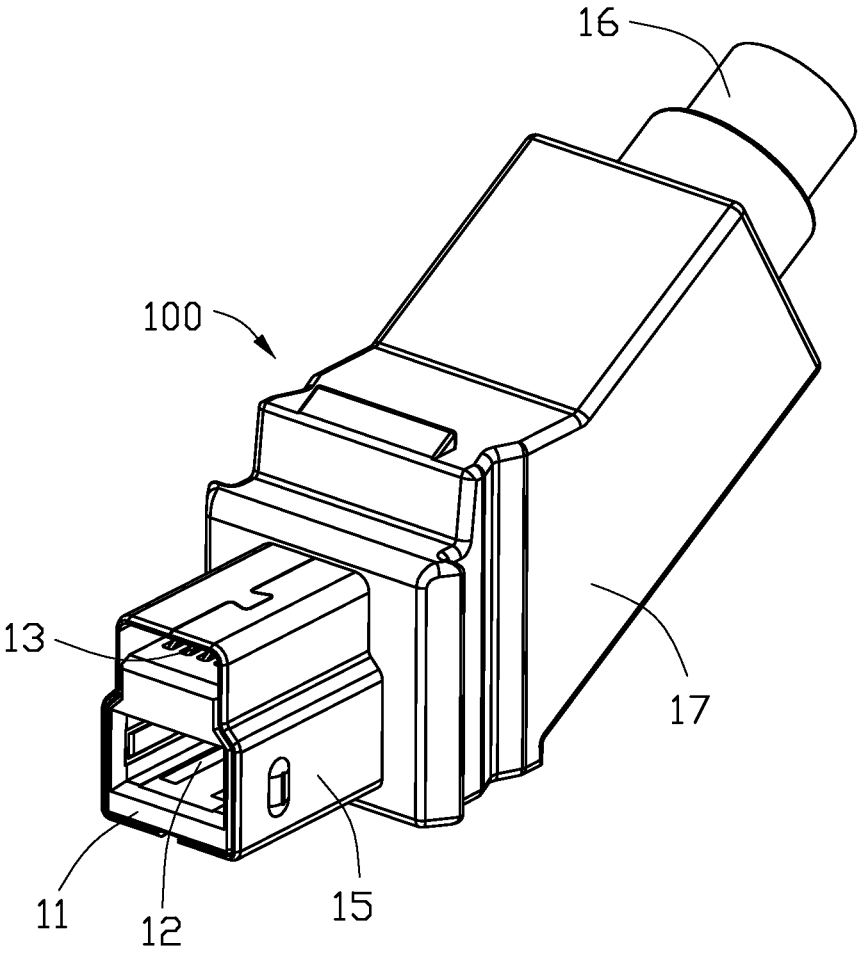
FIG. 2 is similar to FIG. 1, but viewed from another aspect.
Figure 3:
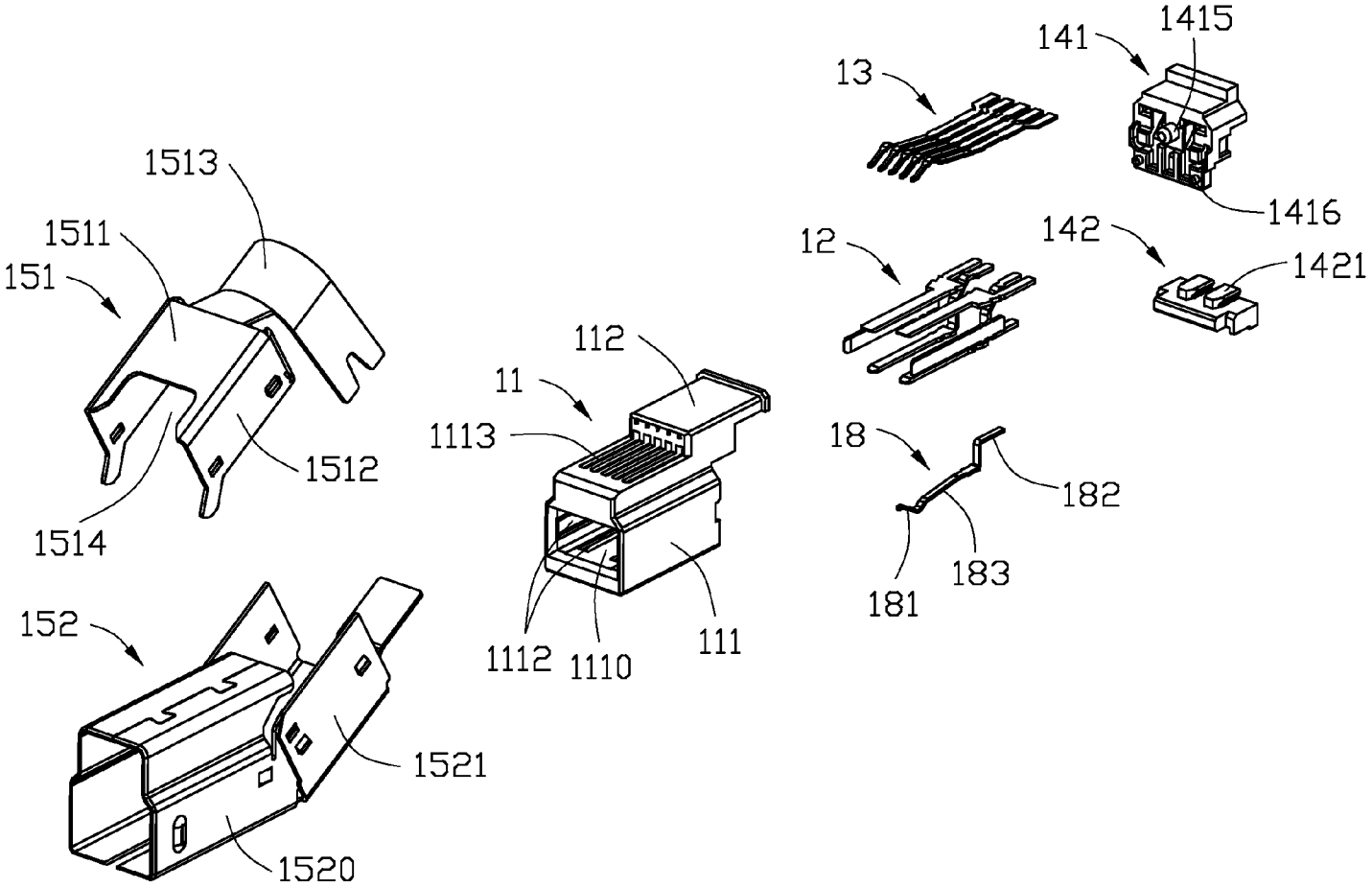
FIGS. 3-4 are exploded views of the plug connector shown in FIG. 1.

Referring to FIGS. 1-3, a plug connector 100 of the electrical connector assembly in accordance with the present invention comprises a plug housing 11, a plurality of first contacts 12 and second contacts 13 received in the plug housing 11, a spacer 14 assembled to the plug housing 11 for retaining the first and second contacts 12, 13, a shielding member 15 enclosing on the plug housing 11, a cable 16 electrically connected with the first and second contacts 12, 13, and an insulative cover 17 molded on the shielding member 15 and the cable 16.

Referring to FIGS. 3-6, the plug housing 11 is molded of dielectric material such as plastic or the like, and comprises a main portion 111 and an extension portion 112 extending backwards a top surface of the main portion 111. A receiving space 1110 is formed by four conjunctive walls of the main portion 111, and extending along a mating direction of the plug connector 100. The main portion 111 has a plurality of passageways 1112 communicating with the receiving space 1110, and a pair of passageways 1112 are recessed downwardly from an inner surface of a bottom wall of the main portion 111, another pair of passageways 1112 are recessed upwardly from an inner surface of a top wall of the main portion 111. The main portion 111 has a passageway 1112 on each lateral inner surface of the receiving space 1110. The passageways 1112 are extending along a front-to-back direction to a back end of the main portion 111. A plurality of slots 1113 are defined on the top surface of the main portion 111.

Figure 4:
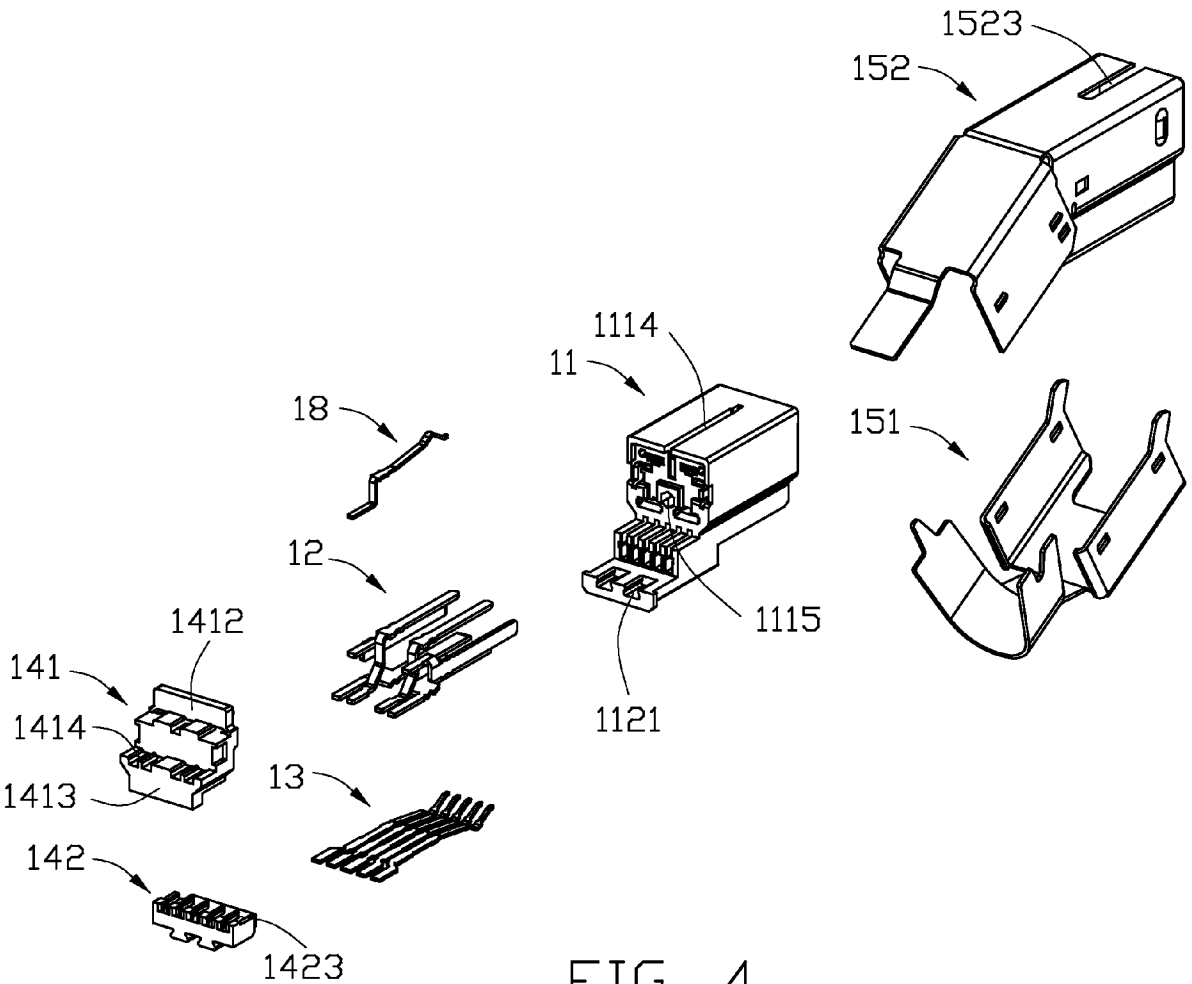
Figure 5:
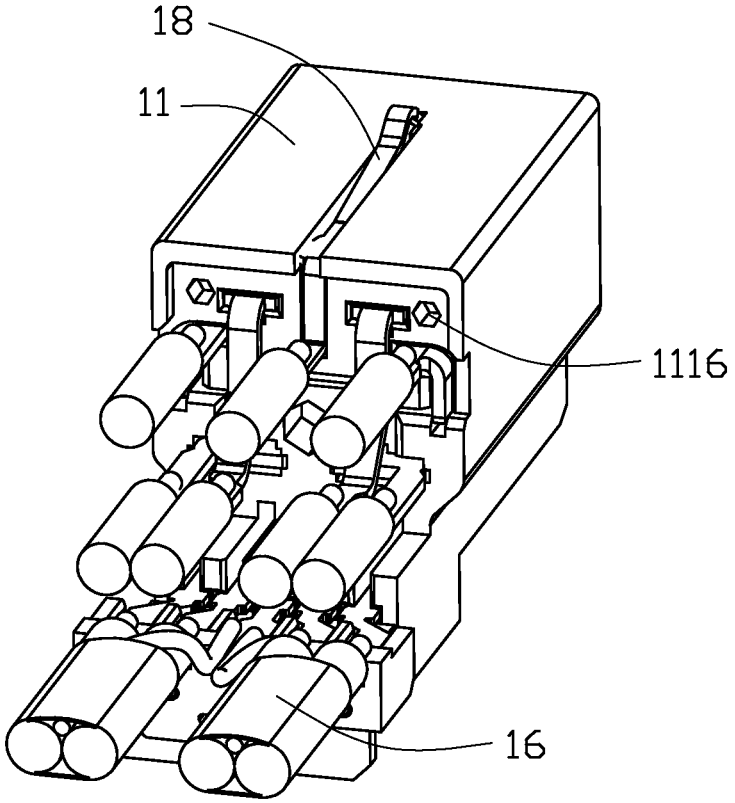
FIGS. 5-6 are partially assembled views of the plug connector shown in FIG. 4.

Referring to FIGS. 3-5, the main portion 111 has a slit 1114 on a bottom surface thereof, and the slit 1114 is extending forwards a certain distance from the back end of the main portion 111, and not penetrating through the main portion 111 along the front-to-back direction. A first positioning hole 1115 and a pair of second positioning holes 1116 are recessed forwards from the back end of the main portion 111, the first positioning hole 1115 is located neighboring to a heart of the back end of the main portion 111, and the pair of second positioning holes 1116 are neighboring to a bottom edge of the main portion 111.

The extension portion 112 has a step-shaped lower surface, and the slots 1113 are extending backwards through the extension portion 112. A pair of fixing dents 1121 are recessed forwards from a back end of the extension portion 112, the fixing dents 1121 are designed as dove-tail grooves, and extending forwards a certain distance but not penetrating through the extension portion 112.

Referring to FIGS. 3-4, the first contacts 12 include six contacts, the second contacts 13 include two pairs of differential contacts and a grounding contact for transmitting high speed signal, the arrangement of the first contacts 12 and the second contacts 13 is in accordance with USB 3.0 Powered-B standard. Each first contact 12 has a stiff contacting portion, and each second contact 13 has an elastic contacting portion.

The first contacts 12 are received in the corresponding passageways 1112 of the plug housing 11, the second contacts 13 are accommodated in the corresponding slots 1113 of the plug housing 11. The first contacts 12 comprise a pair of power contacts with contacting portions on lateral sides and rest four contacts with contacting portions on top and bottom side. Tail portions of the first contacts 12 on lateral sides are located on a first level, and tail portions of the rest first contacts 12 are located on a second level, tail portions of the second contact 13 are located on a third level.

Referring to FIGS. 3-6, the spacer 14 is assembled to the back end of the plug housing 1, and comprises a first spacer 141 and a second spacer 142. The first spacer 141 has a front blocking plate 1412 and a rear blocking plate 1413, and comprises an upper stepped portion and a lower stepped portion. Four grooves 1414 opened downwards are defined on the upper stepped portion, another three grooves 1414 opened downwards are defined on the lower stepped portion, tail portions of the first contacts 12 are received in the corresponding grooves 1414 for electrically connecting with the cable 16. The first spacer 141 defines a first post 1415 and a pair of second posts 1416 extending forwards from a front end surface thereof, and the first post 1415 has a larger diameter than the second post 1416. The first post 1415 is disposed neighboring to a heart of the front end surface of the first spacer 141, and the pair of second posts 1416 are neighboring to a bottom edge of the first spacer 141.

The second spacer 142 defines a pair of guiding ribs 1421 abreast on a top surface thereof, and each guiding rib 1421 extends along the front-to-back direction. A plurality of channels 1423 are arranged on a bottom surface of the second spacer 142 for receiving tail portions of the second contact 13.

Referring to FIGS. 3-4, the shielding member 15 is made of metallic material, and comprises a first shielding piece 151 and a second shielding piece 152 coupled with each other. The second shielding piece 152 comprises a front tube portion 1520 and a bending portion 1521 extending backwards from the tube portion 1520. A narrow cutout 1523 is defined on a bottom surface of the second shielding piece 152 along the front-to-back direction. The first shielding piece 151 is cooperated with the bending portion 1521, and comprises a top wall 1511, a pair of side walls 1512 bending downwards from opposite edges of the top wall 1511, and a holding portion 1513 extending backwards from the top wall 1511, the top wall 1511 has a U-shaped opening 1514.

Figure 6:
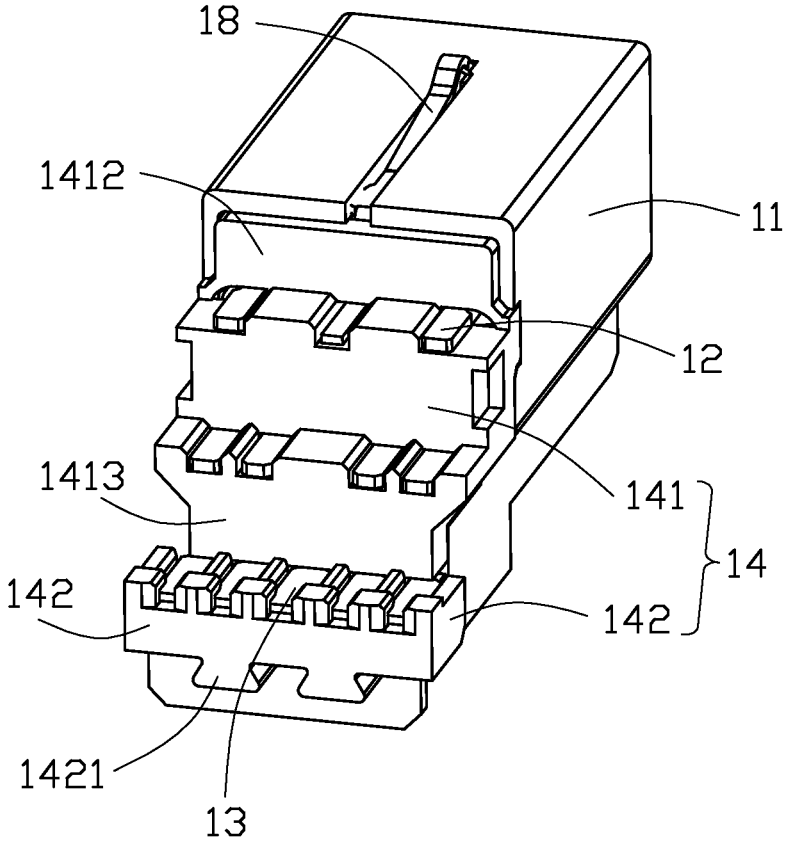
Figure 7:
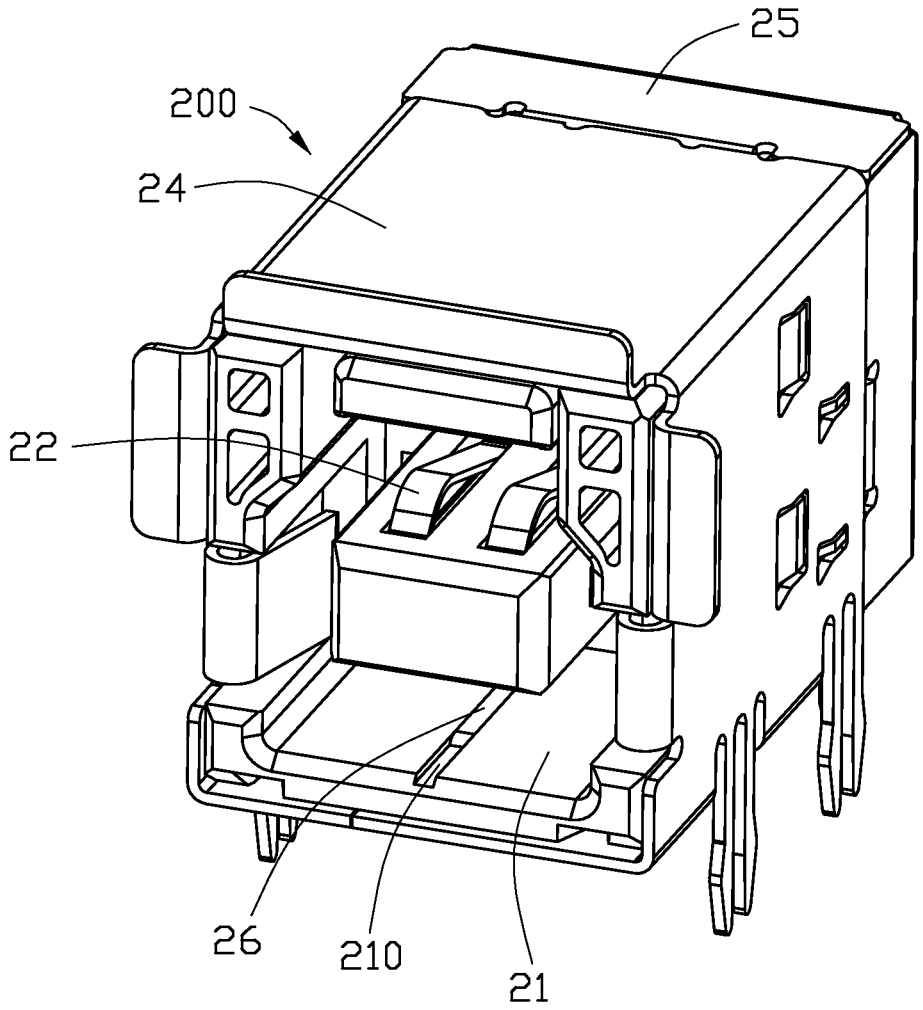
FIG. 7 is an assembled view of a receptacle connector of the electrical connector assembly according to the present invention.
Figure 8:
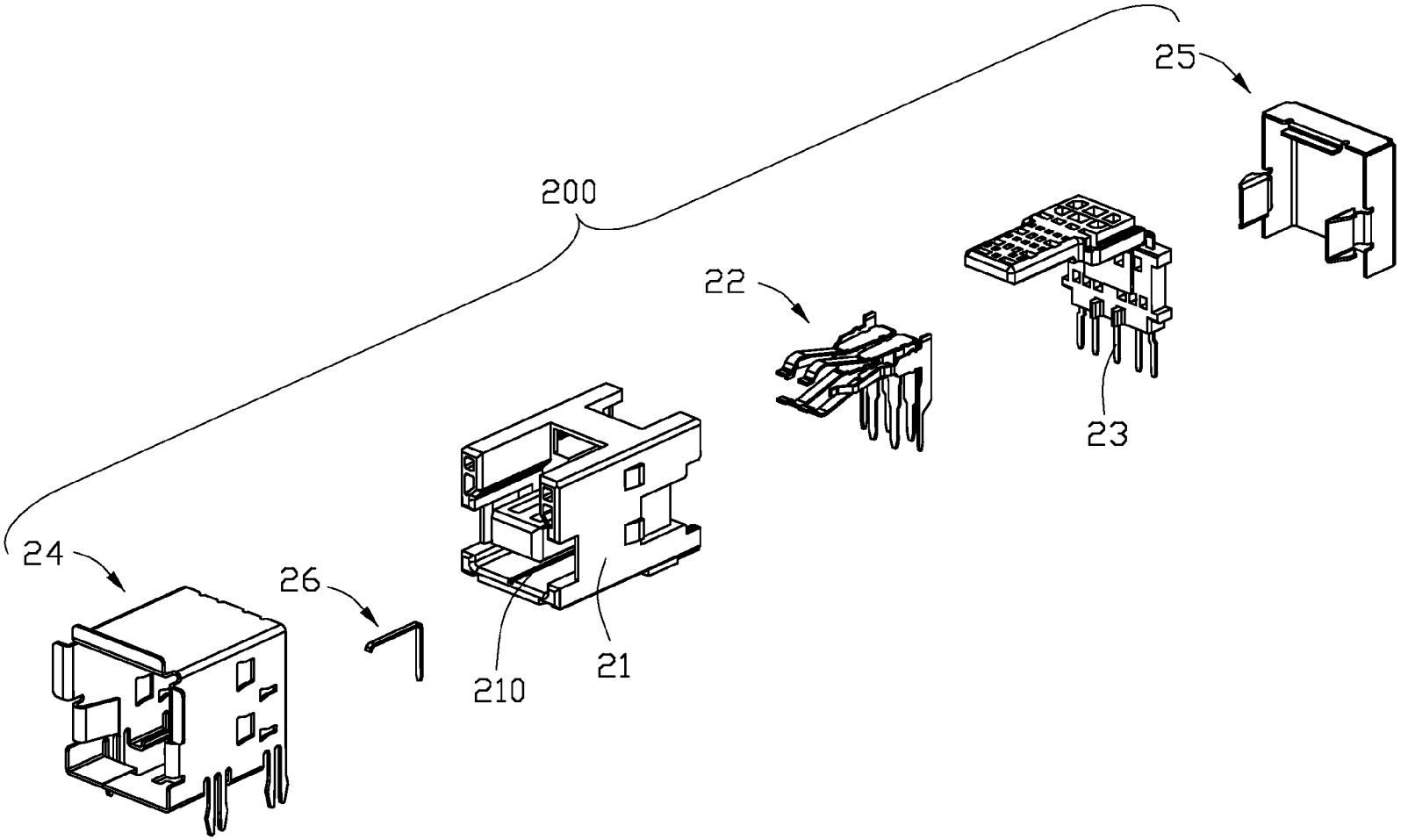
FIG. 8 is an exploded view of the receptacle connector shown in FIG. 7.

Referring to FIGS. 3 and 6, the plug connector 100 further comprises an additional contact 18, and the additional contact 18 comprises an elastic contacting portion 181, a horizontal tail portion 182 and a retaining portion 183 connected the tail portion 182 and the contacting portion 181. The retaining portion 183 and the tail portion 182 are located on different levels, and a vertical portion therebetween is formed. The additional contact 18 is a detective contact, and tail portion 182 of the additional contact 18 is located on the first level same as tail portions of the first contacts 12 on lateral sides.

Referring to FIGS. 3-6, and conjunction with FIG. 1, in assembling of the plug connector 100, the first contacts 12 are assembled into the corresponding passageways 1112 of the plug housing 11, the second contacts 13 are assembled to the corresponding slots 1113 of the plug housing 11. The additional contact 18 is inserted into the slit 1114 of the plug housing 11, with elastic contacting portion 181 exposed beyond the bottom surface of the plug housing 11.

The spacer 14 is assembled to the back end of the plug housing 11, and the first post 1415 of the spacer 14 is inserted into the first positioning hole 1115 of the plug housing 11, the second posts 1416 are inserted into the second positioning holes 1116. The front blocking plate 1412 is adjacent to the back end of the main portion 111, and the rear blocking plate 1413 is adjacent to the back end of the extension portion 112, the rear blocking plate 1413 and the second spacer 142 are assembled to the extension portion 112 together. The tail portion 182 of the additional contact 18 is received in the central groove 1414 on the lower stepped portion. Tail portions of the first contacts 12 are received in the corresponding grooves 1414 on the lower stepped portion of the first spacer 141. Tail portions of the second contacts 13 are received in the channels 1423 of the second spacer 142. Then the plug housing 11 is assembled to the second shielding piece 152, the first shielding piece 151 is engaged with the bending portion 1521 of the second shielding piece 152. The cutout 1523 of the second shielding piece 152 is aligning with the slit 1114 of the plug housing 11, and the additional contact 18 is located in the slit 1114 and exposed in the cutout 1523. A cavity is formed by the main portion 111 of the plug housing 11 and an upper wall of the second shielding piece 152, and the cavity is located above the receiving space 1110, the first contacts 12 are exposed in the receiving space 1110 with the second contacts 13 exposed in the cavity. The cable 16 is electrically connected with tail portions of the first contacts 12, the second contacts 13 and the additional contact 18. The insulative cover 17 is molded on the shielding member 15 and the cable 16.

Figure 9:
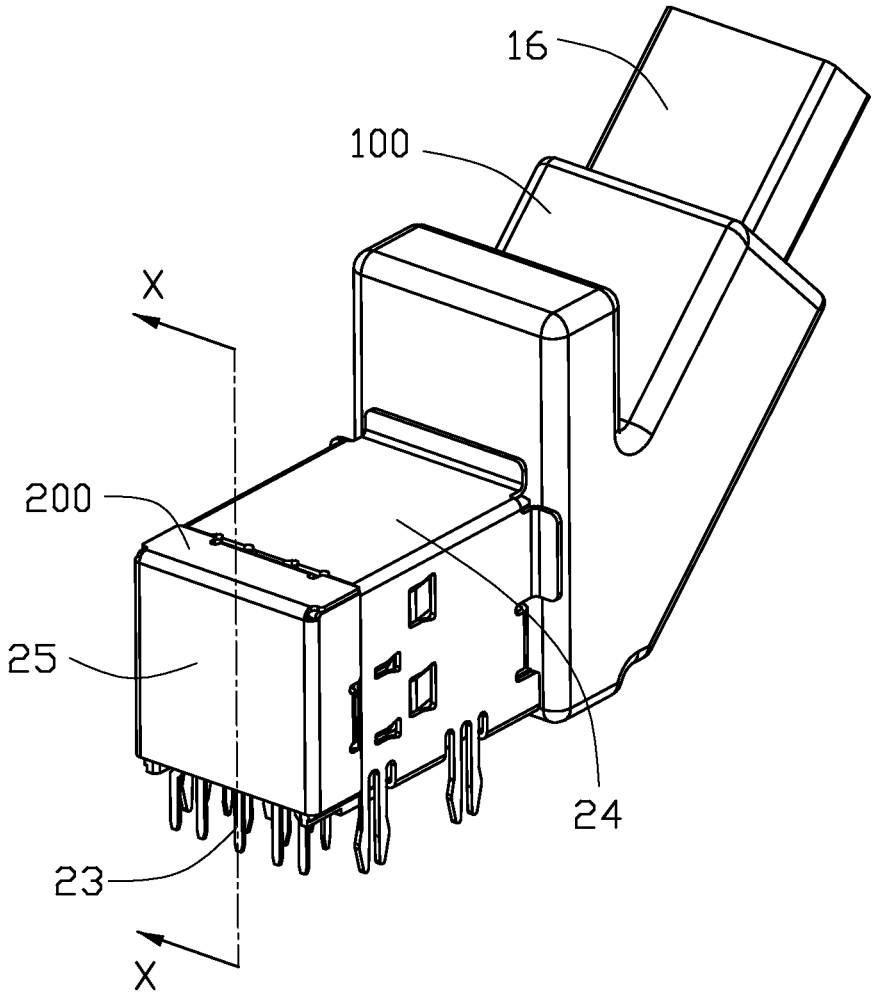
FIG. 9 is a perspective view of the electrical connector assembly, showing a state that the plug connector is fully inserted into the receptacle connector.
Figure 10:
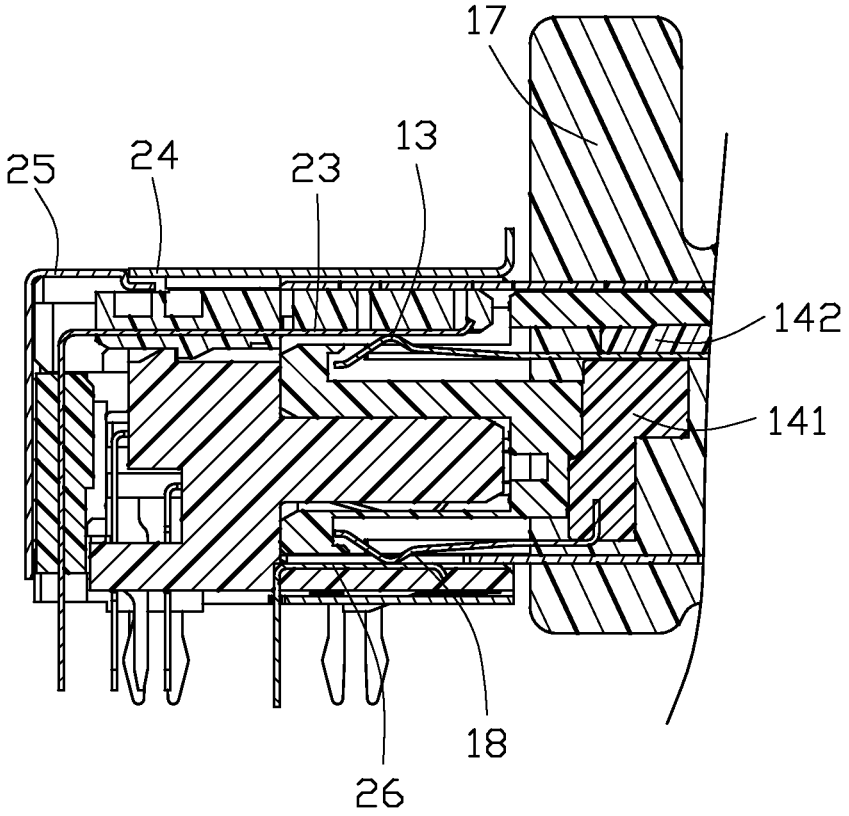
FIG. 10 is a cross section view of the electrical connector assembly taken along line X-X in FIG. 9.

Referring to FIGS. 2 and 9, the insulative cover 17 of the plug connector 100 can be configured of a progressive structure with a stepped portion shown in FIG. 2, and also can be a V-shaped structure with a front vertical rectangular portion shown in FIG. 9. The cable 16 can be a round cable as FIG. 2, and also can be a flat cable as FIG. 9.

Referring to FIGS. 7-10, the receptacle connector 200 is mating the plug connector 100, and comprises a receptacle housing 21 forming therein a receiving cavity (not labeled) with a tongue extending forwardly in the receiving cavity, a plurality of third contacts 22 assembled to the receptacle housing 21, a contact module assembled to the receptacle housing 21 and having a plurality of fourth contacts 23, a metallic shell 24 enclosing on the receptacle housing 21, and a rear cover 25 attached on the metallic shell 24. The receptacle connector 200 also has an extra contact 26 mating with the additional contact 18 of the plug connector 100, and the extra contact 26 has a flat contacting portion, the receptacle housing 21 has a narrow containing slot 210 on a lower wall thereof, and the containing slot 210 is extending along the front-to-back direction and located on a middle position of the lower wall along a transverse direction, the extra contact 26 is located in the containing slot 210.

The additional contact 18 of the plug connector 100 is disposed and exposed on the bottom surface of the plug housing 11, thus can share the existing USB 3.0 Powered-B contacts furthest, and reduce duplication of mould cost.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A plug connector comprising:

a plug housing defining a receiving space;

a plurality of contacts retained in the plug housing, the contacts comprising a plurality of first contacts and a plurality of second contacts, each first contact having a stiff contacting portion with each second contact having an elastic contacting portion, the stiff contacting portions of the first contacts exposed in the receiving space, and the elastic contacting portions of the second contacts exposed in the cavity for transmitting high speed signal;

a cable electrically connected with the contacts; and a shielding member enclosing on the plug housing to form a cavity, the cavity stacked on the receiving space along an up-to-down direction; wherein the plug housing has a slit on a bottom surface thereof, and the slit is communicated with an exterior in the up-to-down direction, the plug connector further comprises an additional contact received in the slit and extending beyond the bottom surface of the plug housing;

wherein the slit is extending forwards a certain distance from a back end of the plug housing, and not penetrating through the plug housing along a front-to-back direction; wherein the plug housing comprises a main portion and an extension portion extending backwards a top surface of the main portion, the extension portion has a step-shaped lower surface; wherein the plug connector further comprises a spacer assembled to the back end of the plug housing, and the spacer comprises a first spacer and a second spacer; wherein the first spacer has a front blocking plate and a rear blocking plate, and comprises an upper stepped portion and a lower stepped portion.

2. The plug connector as recited in claim 1, wherein the additional contact comprises an elastic contacting portion.

3. The plug connector as recited in claim 1, wherein the additional contact is a detective contact.

4. The plug connector as recited in claim 2, wherein each of the first contacts, the second contacts and the additional contact has a contacting portion and a horizontal tail portion.

5. The plug connector as recited in claim 4, wherein the first contacts comprise a pair of power contacts with contacting portions on lateral sides and rest four contacts with contacting portions on top and bottom side.

6. The plug connector as recited in claim 5, wherein tail portions of the first contacts on lateral sides are located on a first level, and tail portions of the rest first contacts are located on a second level, tail portions of the second contact are located on a third level.

7. The plug connector as recited in claim 6, wherein the tail portion of the additional contact is located on the first level same as tail portions of the first contacts on lateral sides.

8. The plug connector as recited in claim 4, wherein the additional contact comprises a retaining portion connected the tail portion and the contacting portion, and the retaining portion and the tail portion are located on different levels, thus a vertical portion therebetween is formed.

9. The plug connector as recited in claim 1, wherein the shielding member comprises a first shielding piece and a second shielding piece coupled with each other, and a narrow cutout is defined on a bottom surface of the second shielding piece along a front-to-back direction.

10. The plug connector as recited in claim 9, wherein the cutout of the second shielding piece is aligning with the slit of the plug housing, and the additional contact is located in the slit and exposed in the cutout.

11. An electrical connector assembly comprising:

a plug connector including:

an insulative first housing defining a receiving space forwardly communicating with an exterior along a front-to-back direction for receiving a mating tongue of a receptacle connector therein;

two rows of first contacts disposed in the housing and located by two sides of the receiving space in a vertical direction perpendicular to said front-to-back direction, each row of the first contacts arranged in a transverse direction perpendicular to both said front-to-back direction and said vertical direction while each of said first contacts extending along the front-to-back direction, each of said first contacts defining a contacting section exposed in the receiving space;

a metallic first shell enclosing the first housing;

a slit formed in an exterior face of the first housing and communicating with the exterior in the vertical direction via said exterior face;

a cutout formed in the first shell and aligned with the slit in the vertical direction; and a resilient contact received within the slit with a corresponding contacting section extending through the cutout in the vertical direction to reach the exterior for mating with the receptacle connector; wherein the receptacle connector includes an insulative second housing with a receiving cavity to receive the plug connector therein, a mating tongue is formed within the receiving cavity to be received within the receiving space of the plug connector during mating, and a stationary contacts is located on an interior face of the second housing and facing toward the receiving cavity for mechanically and electrically connecting to the resilient contact during mating; wherein a plurality of second contacts are disposed in the second housing with corresponding resilient contacting sections exposed upon the mating tongue for mechanically and electrically connecting to the contacting sections of the first contacts, respectively, during mating.

12. The electrical connector assembly as claimed in claim 11, wherein the slit inwardly extends in the vertical direction while being terminated before reaching the receiving space.

13. The electrical connector assembly as claimed in claim 12, wherein said plug connector further includes a pair of lateral contacts by two opposite lateral sides of the receiving space, and a tail of the resilient contact is aligned with those of the lateral contacts in the transverse direction.

* * * * *